United States Patent [19]

Hishida et al.

[11] 4,135,830

[45] Jan. 23, 1979

[54] WIRE PRINTER PRINTING HEAD

[75] Inventors: Yukio Hishida; Yuichi Asai; Toshikatsu Kondo; Akira Asai, all of Nagoya; Atsuo Sakaida, Gifu; Chiaki Miyazawa, Nagoya, all of Japan

[73] Assignee: Brother Kogyo Kabushiki Kaisha, Nagoya, Japan

[21] Appl. No.: 802,000

[22] Filed: May 31, 1977

[30] Foreign Application Priority Data

Jun. 14, 1976 [JP] Japan ..... 51/77288[U]
Jun. 14, 1976 [JP] Japan ..... 51/77289[U]

[51] Int. Cl.[2] ..... B41J 3/12

[52] U.S. Cl. ..... 400/124; 181/201; 181/205; 400/690

[58] Field of Search ..... 101/93.05; 197/1 R, 197/186 B; 181/200–202, 205; 400/124

[56] References Cited

U.S. PATENT DOCUMENTS

| | | | |
|---|---|---|---|
| 2,158,033 | 5/1939 | McKinney | 264/46.4 X |
| 3,770,092 | 11/1973 | Grim | 197/1 R |
| 3,887,057 | 6/1975 | Stahl et al. | 197/186 B |
| 3,889,793 | 6/1975 | Cattaneo | 101/93.05 X |
| 3,896,918 | 7/1975 | Schneider | 101/93.05 X |
| 4,009,772 | 3/1977 | Glaser et al. | 197/1 R |

FOREIGN PATENT DOCUMENTS

| | | | |
|---|---|---|---|
| 2119641 | 11/1972 | Fed. Rep. of Germany | 197/1 R |

*Primary Examiner*—Paul T. Sewell
*Attorney, Agent, or Firm*—George B. Oujevolk

[57] ABSTRACT

A wire printer printing head comprises a support member, a plurality of printing elements having a print wire with a flap-armature electromagnet and a sound absorbing cover. The printing element are radially and slidably mounted to the support member and adjustable to a mounting position of each printing element with respect to the support member by an eccentric pin. The sound absorbing cover composed of a core plate and sound absorbing material is secured to the support member and surrounds all printing elements.

4 Claims, 3 Drawing Figures

WIRE PRINTER PRINTING HEAD

BACKGROUND OF THE INVENTION

This invention relates to a wire printer printing head which utilizes a flap-armature electromagnet as printing wire driving means.

DESCRIPTION OF THE PRIOR ART

An impact type dot printer for forming characters and symbols in dot matrix while reciprocating a wire printer printing head operated by a flap-armature electromagnet along a printing surface which selectively drives a printing wire is widely used as an output device for an electronic computer or the like.

This impact type dot printer must always maintain a predetermined quality of printing, and so must retain a uniform interval between the printing surface and the printing wire end. Therefore an adjusting operation for a head base is necessary for every printing element. In addition, the adjusting operation requires simplicity and accuracy without affecting the printing pressure of each printing element by a suitable adjusting mechanism.

In this impact type dot printer, the sound produced by the operation of the printing gives the operator a severe discomfort and a highly efficient sound eliminating arrangement is needed.

OBJECTS OF THE INVENTION

It is an object of this invention to provide a printing head which can simply and accurately adjust each printing element for a head support member.

Another object of this invention is to provide a printing head so constructed as not to affect the printing pressure of each printing element by the adjusting operation of each printing element for a head support member.

Still another object of this invention is to provide a printing head which eliminates sound during the printing operation.

DETAILED DESCRIPTION OF THE INVENTION

Figure 1:
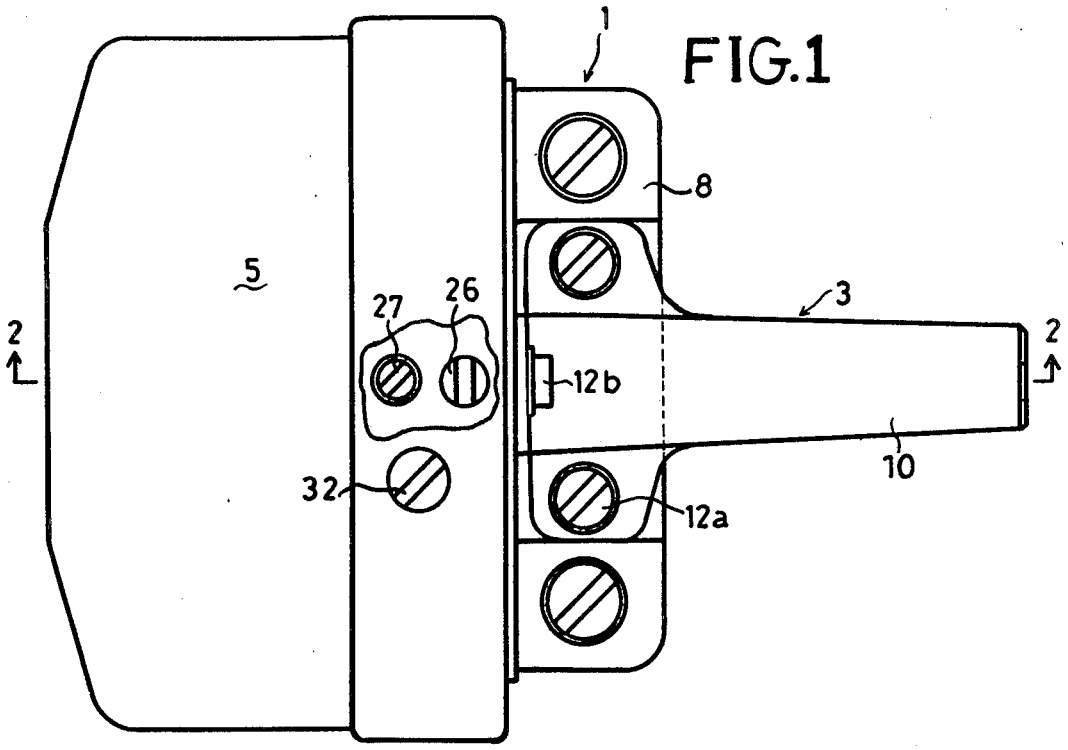
FIG. 1 is a plane view of a printing head embodying the invention.

A dot matrix type wire printer printing head 1 is composed of a head support member 2 (FIG. 3), a printing wire guide 3, a printing element 4 (FIG. 2) and a sound absorbing cover 5.

The head support member 2 is so made of aluminum material as to have large heat capacity and small mass, and is shaped substantialy like a semicircular disk having flat left and right surfaces 2*a* and 2*b*. A guide hole 6 is perforated from the left surface 2*a* to the right surface 2*b* of the support member 2 is formed at the center of the support member 2. Seven inserting bores 7 are formed from left surface 2*a* to the right surface 2*b* of the support member 2 at equal intervals on the same circumference around the hole 6 as a center. A bed 8 is provided at the right surface 2*b* of the support member 2 and projects from the lower portion of the guide hole 6 to be elevationally extended in blade shape in FIG. 1.

The printing wire guide 3 is composed of a plastic trough member 9 including groove 9*a* formed thereon, a metallic dustproof cover 10 over the top of groove 9*a*, and four guide plates 11 provided in the groove 9*a*. The trough member 9 is fixed to the bed 8 with screws 12*a* in such a manner that the rear end of the groove 9*a* matches the guide hole 6 of the support member 2. The dustproof cover 10 is also fixed to the right surface 2*b* of the support member 2 with screw 12*b* for coating the top of the groove 9*a*.

Figure 2:
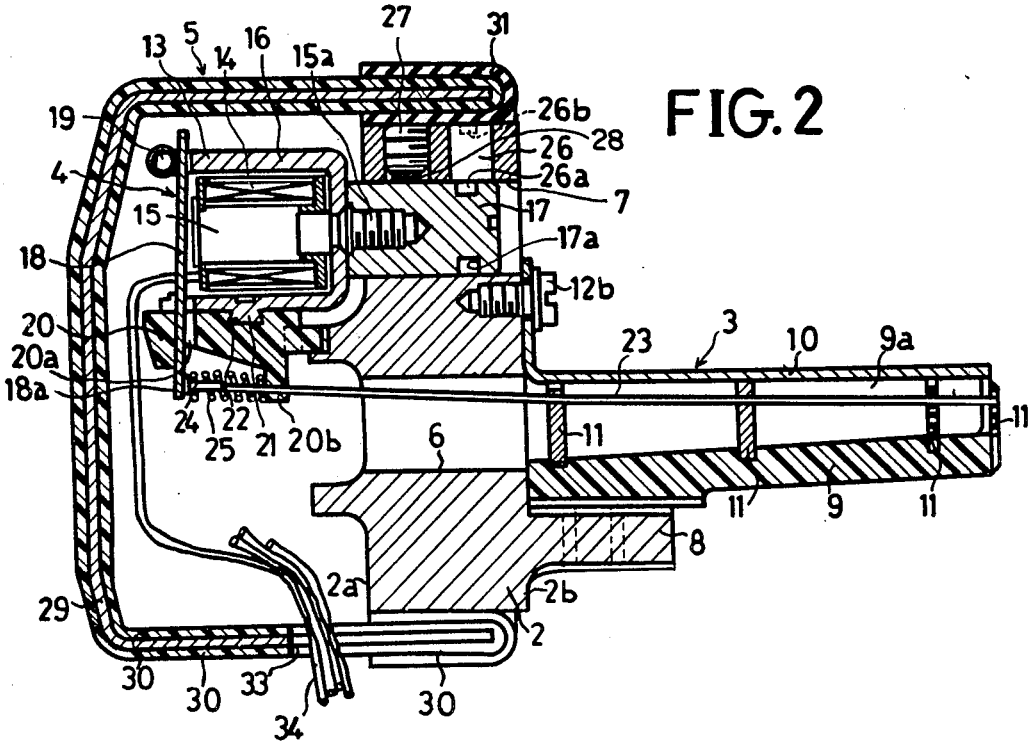
FIG. 2 is a cross-sectional view taken along the section line 2—2 of FIG. 1 showing the major components of the printing head.
Figure 3:
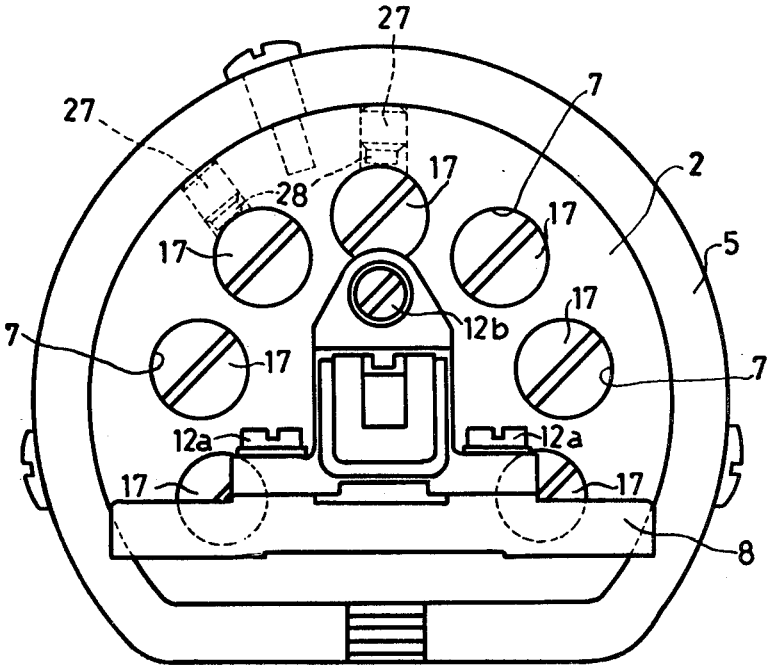
FIG. 3 is a right side view of the FIG. 1.

More particularly, the support member 2 is fixed to the printing wire guide 3 so that the guide hole 6 coincides in the same axial direction as shown in FIG. 2 with the groove 9*a* of the trough member 9. Further, since the support member 2 is formed of different material with respect to resonant point from the trough member 9 of the wire guide 3, vibrations of both the materials are mutually restricted without increase.

The printing element 4 will now be described in detail.

The flap-armature electromagnet 13 is secured to the front end 15*a* of an iron core 15 wound with a coil 14 thereon and with a yoke 16 of substantially U-shape surrounding the coil 14 and is further secured to a base member shaped in a rod 17 of aluminum at the thread portion of the front end 15*a* of the core 15. Annular groove 17*a* is formed at the right end of the rod 17 in FIG. 2. A flap-armature 18 is rockingly supported at the base end between projection 19 (only one is shown) formed at the rear top of the yoke 16, and has an actuating portion 18*a* formed in narrow width at the end thereof. Synthetic resin auxiliary frame 20 is attached to the yoke 16 by engaging a dove-tail shape projection 21 projected from the lower surface of the yoke 16 in FIG. 2 with a dove-tail shape groove 22.

A hole 20*a* elevationally perforated through one end of the auxiliary frame 20 is formed as shown in FIG. 2, and the actuating portion 18*a* of the flap-armature 18 is movably inserted into the hole 20*a*. A supporting portion 20*b* is downwardly projected from the frame 20 for supporting a printing wire 23 slidably. A button 24 is secured to the rear end of the printing wire 23, and a compression spring 25 is interposed between the button 24 and the supporting portion 20*b*. This spring 25 serves to urge the printing wire 23 leftwardly in FIG. 2 and also to urge the actuating portion 18*a* of the flap-armature 18 leftwardly.

After the printing elements 4 thus constructed are assembled, the rods 17 are inserted into respective inserting bores 7 of the support member 2 so that the printing wire 23 is inserted through the guide hole 6 to the guide plate 11 (only one rod 17 is shown in FIG. 2).

An eccentric pin 26 is rotatably supported on the support member 2 so that a lower projection 26*a* of the pin 26 is engaged with the annular groove 17*a*. So the rod 17 inserted into the inserting bore 7 is slid rightwardly and leftwardly in FIG. 2 in the inserting bore 7 by suitably rotating the eccentric pin 26 using a tool from outside of the support member.

More particularly, upon rotating the eccentric pin 26, the printing element 4 is integrally moved laterally with respect to the support member in FIG. 2 to adjust the projected amount of the printing wire 23 from the printing wire guide 3 so the aforementioned adjusting operation does not affect the compression force of the compresssion spring 25. Accordingly the printing pressure of each printing element 4 can always have a predetermine force.

If the rod 17 is once positioned by the eccentric pin 26, the rod 17 and accordingly the printing element 4 is positioned via aluminum washer 28 by tightening a lock screw 27 operable from outside of the support member 2. When the electromagnet 13 is energized, the flap-armature 18 is rotated so that the printing element 4 thus assembled with the support member 2 is so operated as to move the printing wire 23 rightwardly in FIG. 2 against the compression spring 25 to carry out a printing operation. When the electromagnet 13 is deenergized, the flap-armature 18 is returned to the original position before rotation by the compression spring 25 and thus returns the printing wire 23. When the electromagnet 13 is rapidly and continuously operated repeatedly as aforementioned, it produces an extremely large quantity of heat, but this heat is transmitted to aluminum rod 17 having relatively large thermal transmission rate via the iron core 15 or the yoke 16, and the heat is immediately transferred from the rod 17 to aluminum support member 2 having a large heat sink capacity. Such aluminum support member 2 may have relatively large volume and accordingly have large heat capacity to quickly absorb the heat from the electromagnet 13 and to rapidly radiate the heat to the atmosphere. Since the aluminum support member 2 can efficiently absorb and exhalate the quantity of heat, the temperature of the printing head 1 can be maintained at a relatively low temperature.

The sound absorbing cover 5 will now be described in detail.

This cover 5 is composed of an aluminum core plate 29 and thermal foaming sound absorbing material 30 secured to cover both surfaces of the core plate 29. After the core plate 29 is formed as shown in FIG. 1 or 2, sound absorbing paint such as polyvinyl chloride foaming plastisol is coated on both surfaces of the core plate 29, and after the core plate 29 is heated to foam the sound absorbing paint for solidification. Thereby the thermal foaming sound absorbing material 30 is secured to both surfaces of the core plate 29. The cover 5 thus constructed is secured to the support member 2 with screws 32 for surrounding the all printing elements 4 via rubber vibration insulator 31.

More particularly, the printing element 4 is isolated from the external field by sound absorbing cover 5 and the support member 2. Thus, most sound produced from the printing element 4 is absorbed in the sound absorbing cover 5 with the result that the sound amount leaked to the external field is extremely little.

The sound absorbing cover 5 thus attached to the support member 2 may efficiently absorb the sound produced from the printing element 4 and may easily be fabricated and assembled.

Reference numeral 33 represents a guide port provided at the sound absorbing cover 5 for introducing lead wires 34 of the electromagnet 13.

We claim:

1. In a wire print device for printing on a record medium, a print head comprising:

(a) a disk member which acts as a support, said disk member having a plurality of radially arranged cylindrical bores parallel to an axis of said disk member;

(b) a plurality of wire print assembly members supported by said disk member, each of said wire print assembly members having an electromagnet with a flap-armature and a yoke, an auxiliary frame member fixed to the yoke, a printing wire with a top portion movably supported by said auxiliary member along the longitudinal direction thereof, and a spring mounted between said wire and said auxiliary frame member for enabling said printing wire top portion to establish contact with said flap-armature;

(c) a plurality of rod members respectively secured to each of said wire print assembly members, each of said rod members being provided with an annular groove on a periphery thereof, said rod member being inserted into each of said cylindrical bores so that said wire print assembly members are radially arranged on said disk member;

(d) a plurality of eccentric pins each with a lower projection supported on said disk member so that said lower projection of each eccentric pin is engaged with the annular groove of said rod member for adjusting the supporting position of each of said rod members in said cylindrical bore; and, (e) a plurality of lock screws supported on said disk member for respectively locking each of said rod members at the adjusted position in each of said cylindrical bores.

2. In a wire print device as set forth in claim 1 wherein:

(a) said printing wire has a button at the top thereof; and, (b) said spring is mounted between the button and the auxiliary member for enabling a top of the button to establish contact with said flap-armature.

3. In a wire print device as set forth in claim 2 wherein each of said lock screws has a top and the top of said lock screw and said eccentric pin corresponding to each of said rod member is arranged on a line along an axis of each of said rod member.

4. In a wire print device as set forth in claim 1, a covering member fixed to the outer circumferential surface of said support disk so that the covering member covers all of said flap-armature electromagnets to isolate all of said flap-armature electromagnets from any external field, said covering member consisting of an aluminum core plate and, sound absorbing foam material on at least one side of said aluminum core plate.

* * * * *